US010113137B2

(12) United States Patent
Köhle et al.

(10) Patent No.: US 10,113,137 B2
(45) Date of Patent: Oct. 30, 2018

(54) FABRIC SOFTENER ACTIVE COMPOSITION

(71) Applicant: Evonik Degussa GmbH, Essen (DE)

(72) Inventors: Hans-Jürgen Köhle, Mainhausen (DE); Marc Johan Declercq, Strombeek-Bever (BE); Pieter Jan Maria Saveyn, Heusden (BE)

(73) Assignee: Evonik Degussa GmbH, Essen (DE)

( * ) Notice: Subject to any disclaimer, the term of this patent is extended or adjusted under 35 U.S.C. 154(b) by 16 days.

(21) Appl. No.: 15/517,220

(22) PCT Filed: Oct. 1, 2015

(86) PCT No.: PCT/EP2015/072665
§ 371 (c)(1),
(2) Date: Apr. 6, 2017

(87) PCT Pub. No.: WO2016/055341
PCT Pub. Date: Apr. 14, 2016

(65) Prior Publication Data

US 2017/0298294 A1 Oct. 19, 2017

(30) Foreign Application Priority Data

Oct. 8, 2014 (EP) ..... 14188042

(51) Int. Cl.
*C11D 1/62* (2006.01)
*C11D 1/645* (2006.01)
*C11D 3/00* (2006.01)

(52) U.S. Cl.
CPC ..... *C11D 1/645* (2013.01); *C11D 3/001* (2013.01); *C11D 3/0015* (2013.01); *C11D 1/62* (2013.01)

(58) Field of Classification Search
CPC ..... C11D 1/46; C11D 1/62
See application file for complete search history.

(56) References Cited

U.S. PATENT DOCUMENTS

| | | | |
|---|---|---|---|
| 4,234,627 | A | 11/1980 | Schilling |
| 4,514,461 | A | 4/1985 | Woo |
| 4,747,880 | A | 5/1988 | Berrido et al. |
| RE32,713 | E | 7/1988 | Woo |
| 4,789,491 | A | 12/1988 | Chang et al. |
| 4,882,220 | A | 11/1989 | Ono et al. |
| 4,917,920 | A | 4/1990 | Ono et al. |
| 4,954,285 | A | 9/1990 | Wierenga et al. |
| 5,002,681 | A | 3/1991 | Wierenga et al. |
| 5,137,646 | A | 8/1992 | Schmidt et al. |
| 5,185,088 | A | 2/1993 | Hartman |
| 5,391,325 | A | 2/1995 | Swenson et al. |
| 5,427,697 | A | 6/1995 | Swartley |
| 5,474,691 | A | 12/1995 | Severns |
| 5,476,599 | A | 12/1995 | Rusche et al. |
| 5,480,567 | A | 1/1996 | Lam et al. |
| 5,703,029 | A | 12/1997 | Crass et al. |
| 5,759,990 | A | 6/1998 | Wahl et al. |
| 5,792,219 | A | 8/1998 | Hartman et al. |
| 5,827,451 | A | 10/1998 | Cummings et al. |
| 5,830,845 | A | 11/1998 | Trinh et al. |
| 5,877,145 | A | 3/1999 | Wahl et al. |
| 5,916,863 | A | 6/1999 | Iacobucci et al. |
| 6,004,913 | A | 12/1999 | Iacobucci et al. |
| 6,037,315 | A | 3/2000 | Franklin et al. |
| 6,180,593 | B1 | 1/2001 | Fender et al. |
| 6,180,594 | B1 | 1/2001 | Fender et al. |
| 6,200,949 | B1 | 3/2001 | Reijmer et al. |
| 6,235,914 | B1 | 5/2001 | Steiger et al. |
| 6,255,274 | B1 | 7/2001 | Becherer et al. |
| 6,376,455 | B1 | 4/2002 | Friedli et al. |
| 6,458,343 | B1 | 10/2002 | Zeman et al. |
| 6,492,322 | B1 | 12/2002 | Cooper et al. |
| 6,608,024 | B1 | 8/2003 | DuVal et al. |
| 6,645,479 | B1 | 11/2003 | Shefer et al. |
| 6,653,275 | B1 * | 11/2003 | Fender ..... C11D 1/62 510/522 |
| 6,770,608 | B2 | 8/2004 | Franklin et al. |
| 6,878,684 | B2 | 4/2005 | Ellson et al. |
| 6,897,194 | B2 | 5/2005 | Fan et al. |
| 6,987,074 | B2 | 1/2006 | Ishii et al. |
| 6,995,131 | B1 | 2/2006 | Frankenbach |
| 7,572,761 | B2 | 8/2009 | Gefvert |
| 7,704,940 | B2 | 4/2010 | Boerefijn et al. |
| 7,994,110 | B2 | 8/2011 | Wenk et al. |
| 8,183,199 | B2 | 5/2012 | Fossum et al. |
| 8,361,953 | B2 | 1/2013 | Nagy et al. |
| 8,507,425 | B2 | 8/2013 | Schick et al. |
| 8,563,499 | B2 | 10/2013 | Köhle et al. |
| 8,569,224 | B2 | 10/2013 | Köhle et al. |
| 8,883,712 | B2 | 11/2014 | Köhle et al. |
| 8,883,713 | B2 | 11/2014 | Parrish et al. |
| 9,441,187 | B2 | 9/2016 | Köhle et al. |

(Continued)

FOREIGN PATENT DOCUMENTS

| | | |
|---|---|---|
| CA | 1312619 | 1/1993 |
| CS | 246532 | 3/1986 |

(Continued)

OTHER PUBLICATIONS

International Search Report for international application PCT/EP2015/072665 filed Oct. 1, 2015.

(Continued)

*Primary Examiner* — John E Hardee
(74) *Attorney, Agent, or Firm* — Law Office of: Michael A. Sanzo, LLC

(57) ABSTRACT

A fabric softener active composition, comprising as component A at least 50% by weight of a bis-(2-hydroxypropyl)-dimethylammonium methylsulphate fatty acid ester having a molar ratio of fatty acid moieties to amine moieties of from 1.5 to 1.99, an average chain length of the fatty acid moieties of from 16 to 18 carbon atoms and an iodine value of the fatty acid moieties, calculated for the free fatty acid, of from 0.5 to 50, and as component B a (2-hydroxypropyl)-(1-methyl-2-hydroxyethyl)-dimethylammonium methylsulphate fatty acid ester having the same fatty acid moieties as component A, and wherein the molar ratio of component B to component A is from 0.05 to 0.20.

20 Claims, No Drawings

(56) References Cited

U.S. PATENT DOCUMENTS

| | | | | |
|---|---|---|---|---|
| 2002/0032146 | A1 | 3/2002 | Schaumann et al. | |
| 2003/0060390 | A1 | 3/2003 | Demeyere et al. | |
| 2003/0139313 | A1 | 7/2003 | Turner et al. | |
| 2003/0158344 | A1 | 8/2003 | Rodrigues et al. | |
| 2003/0165692 | A1 | 9/2003 | Koch et al. | |
| 2003/0195130 | A1 | 10/2003 | Lentsch et al. | |
| 2003/0195133 | A1 | 10/2003 | Shefer et al. | |
| 2003/0203829 | A1 | 10/2003 | Shefer et al. | |
| 2003/0215417 | A1 | 11/2003 | Uchiyama et al. | |
| 2003/0216282 | A1 | 11/2003 | Martens et al. | |
| 2003/0216488 | A1 | 11/2003 | Uchiyama et al. | |
| 2003/0220210 | A1 | 11/2003 | DuVal et al. | |
| 2004/0071742 | A1 | 4/2004 | Popplewell et al. | |
| 2004/0071746 | A1 | 4/2004 | Popplewell et al. | |
| 2004/0072719 | A1 | 4/2004 | Bennett et al. | |
| 2004/0072720 | A1 | 4/2004 | Brain et al. | |
| 2004/0087477 | A1 | 5/2004 | Ness | |
| 2004/0106536 | A1 | 6/2004 | Mane et al. | |
| 2004/0167056 | A1 | 8/2004 | Lentsch et al. | |
| 2004/0204337 | A1 | 10/2004 | Corona et al. | |
| 2005/0014672 | A1 | 1/2005 | Arif | |
| 2005/0032671 | A1 | 2/2005 | Kvita et al. | |
| 2006/0089293 | A1 | 4/2006 | Frankenbach | |
| 2006/0094639 | A1 | 5/2006 | Martin et al. | |
| 2006/0142175 | A1 | 6/2006 | Haiss et al. | |
| 2006/0252669 | A1 | 11/2006 | Heibel et al. | |
| 2006/0277689 | A1 | 12/2006 | Hubig et al. | |
| 2007/0054835 | A1 | 3/2007 | Corona et al. | |
| 2007/0066510 | A1 | 3/2007 | Tee et al. | |
| 2007/0179080 | A1 | 8/2007 | Gallotti | |
| 2007/0219111 | A1 | 9/2007 | Ward et al. | |
| 2008/0242584 | A1 | 10/2008 | Wahl et al. | |
| 2008/0263780 | A1 | 10/2008 | Declercq et al. | |
| 2008/0289116 | A1 | 11/2008 | Young et al. | |
| 2009/0124533 | A1 | 5/2009 | Kottke et al. | |
| 2009/0181877 | A1 | 7/2009 | McGinnis et al. | |
| 2011/0110993 | A1 | 5/2011 | Chieffi et al. | |
| 2011/0239377 | A1* | 10/2011 | Fossum | C11D 1/62 8/137 |
| 2011/0239378 | A1 | 10/2011 | Fossum et al. | |
| 2011/0245138 | A1* | 10/2011 | Kohle | C07C 213/06 510/515 |
| 2011/0245140 | A1 | 10/2011 | Demeyere | |
| 2012/0021959 | A1 | 1/2012 | Morgan, III et al. | |
| 2012/0328790 | A1 | 12/2012 | Nagy et al. | |
| 2015/0126431 | A1 | 5/2015 | Köhle et al. | |
| 2016/0102273 | A1* | 4/2016 | Declercq | C11D 3/001 510/527 |

FOREIGN PATENT DOCUMENTS

| | | | |
|---|---|---|---|
| DE | 24 30 140 | A1 | 2/1976 |
| DE | 34 02 146 | A1 | 7/1985 |
| DE | 36 08 093 | A1 | 9/1987 |
| DE | 197 08 133 | | 12/1997 |
| EP | 0 284 036 | | 9/1988 |
| EP | 0 293 955 | A2 | 12/1988 |
| EP | 0 302 567 | A2 | 2/1989 |
| EP | 0 421 146 | A2 | 9/1990 |
| EP | 0 829 531 | A1 | 3/1998 |
| EP | 1 018 541 | A1 | 7/2000 |
| EP | 1 323 817 | A1 | 12/2001 |
| EP | 1 393 706 | A1 | 3/2004 |
| EP | 1 584 674 | A1 | 10/2005 |
| EP | 1 840 197 | A1 | 2/2007 |
| EP | 1 806 392 | A1 | 7/2007 |
| GB | 2 007 734 | A | 5/1979 |
| GB | 2 039 556 | | 8/1980 |
| WO | WO 91/01295 | | 2/1991 |
| WO | WO 92/18593 | | 10/1992 |
| WO | WO 94/14935 | | 7/1994 |
| WO | WO 94/19439 | | 9/1994 |
| WO | WO 97/42279 | | 11/1997 |
| WO | WO 98/38277 | | 9/1998 |
| WO | WO 00/06678 | | 2/2000 |
| WO | WO 01/32813 | A1 | 5/2001 |
| WO | WO 01/42412 | A1 | 6/2001 |
| WO | WO 2005/037973 | A1 | 4/2005 |
| WO | WO 2005/085404 | A1 | 9/2005 |
| WO | WO 2005/095568 | A1 | 10/2005 |
| WO | WO 2007/026314 | A2 | 3/2007 |
| WO | WO 2007/125005 | | 11/2007 |
| WO | WO 2008/003454 | A1 | 1/2008 |
| WO | WO 2008/104509 | | 9/2008 |
| WO | WO 2009/018955 | A2 | 2/2009 |
| WO | WO 2009/099618 | A1 | 8/2009 |
| WO | WO 2011/120822 | A1 | 10/2011 |
| WO | WO 2011/120836 | A1 | 10/2011 |
| WO | WO 2011/123284 | A1 | 10/2011 |
| WO | WO 2011/123606 | A1 | 10/2011 |
| WO | WO 2011/123733 | A1 | 10/2011 |
| WO | WO 2012/061093 | A1 | 5/2012 |
| WO | WO 2013/167376 | A1 | 11/2013 |

OTHER PUBLICATIONS

Written Opinion of the International Searching Authority for international application PCT/EP2015/072665 filed Oct. 1, 2015.

International Preliminary Report on Patentability for international application PCT/EP2015/072665 filed Oct. 1, 2015.

European Search Report for EP 14 18 8042 filed Oct. 8, 2014.

XP-002721964; English language abstract for JP 2013133547 dated Aug. 12, 2013.

Akram, et al., "Synthesis of Tallow Based Esterquat," *J Sci Res* vol. XXX (1):31-36 (Jun. 2010).

Price-Jones, et al., "N,N'-ethylenediyl-bis-alkanamides: Differential scanning calorimetry studies," *J. Am. Oil Chem. Soc.* 73:311-319 (Mar. 1996).

Product Advertisement for Tetranyl AO-1, http//kaochemicals-eu.com/213.html, downloaded Jul. 27, 2011.

Ullman'S Encyclopedia of Industrial Chemistry; Wiley-VCH Verlag GmbH & Co. KGaA, Weinheim, vol. 14, Table 2, p. 77 (2012).

U.S. Appl. No. 14/531,507, filed Nov. 3, 2014, US-2015/0126431 A1, May 7, 2015, Köhle.

* cited by examiner

FABRIC SOFTENER ACTIVE COMPOSITION

CROSS REFERENCE TO RELATED APPLICATIONS

The present application is US national stage of international application PCT/EP2015/072665, which had an international filing date of Oct. 1, 2015, and which was published in English under PCT Article 21(2) on Apr. 14, 2016. Priority is claimed to European application EP 14188042.7, filed on Oct. 8, 2014.

The present invention relates to fabric softener active compositions having high softening performance and providing aqueous formulations with good storage stability and high viscosity.

Quaternary ammonium salts carrying two hydrophobic long chain hydrocarbon moieties have found broad use as fabric softener actives. Quaternary ammonium salts of alkanolamines esterified with on average two fatty acid moieties per molecule, commonly referred to as ester quats, have largely replaced earlier alkyl quaternary ammonium compounds because of their biodegradability.

For use in rinse cycle softener products, a softener active composition has to meet several and sometimes conflicting requirements:

- High softening performance in terms of soft touch and fabric rewettability, and
- good storage stability in aqueous dispersion with high dispersion viscosity.

The ester quats which have found the broadest technical use and which today set the standard for softening performance are methyltriethanolammonium methylsulphate fatty acid diesters and dimethyldiethanolammonium chloride fatty acid diesters. However, aqueous dispersions of these fabric softener actives have limited stability and extended storage of such aqueous dispersions at temperatures in excess of 40° C. will usually lead to an inacceptable rise in dispersion viscosity or to settling of the softener active. Furthermore, these fabric softener actives cannot be handled and processed to aqueous dispersions without the addition of a solvent because of their high melting points and melt viscosities and the limited thermal and hydrolytic stability of the fabric softener actives. Therefore, they are usually delivered and processed with a content of 5 to 15% by weight ethanol or isopropanol, which requires additional precautions due to the volatility and flammability of the solvent.

EP 0 293 955 A2 and EP 0 302 567 A2 disclose aqueous fabric softener dispersions having high storage stability and little change in viscosity during storage and a method for preparing such dispersions. These compositions contain a bis-(2-hydroxypropyl)-dialkylammonium salt fatty acid diester as the fabric softener active in the form of submicrometer particles. However, preparation of these dispersions requires processing the fabric softener active mixed with from 5 to 50% by weight of a $C_1$-$C_4$ monohydric alcohol. In the examples, bis-(2-hydroxypropyl)-dimethylammonium chloride palmitic acid diester is used as the fabric softener active and isopropanol is used as the solvent.

DE 24 30 140 C3 discloses bis-(2-hydroxypropyl)-dialkylammonium salt fatty acid diesters for providing liquid fabric softener actives. Example 2 discloses the preparation of a bis-(2-hydroxypropyl)-dimethylammonium methylsulphate fatty acid diester by reacting a bis-(2-hydroxypropyl)-methylamine fatty acid diester of a fatty acid having an average chain length of 19 to 20 carbon atoms and comprising 90% by weight unsaturated fatty acid moieties with dimethyl sulphate in a molar ratio of 1:1.

EP 1 018 541 A1 discloses clear fabric softener compositions comprising an ester quat and an alkoxylated phenol or branched C3-C6 alcohol solvent. Example 6 discloses a composition containing a bis-(2-hydroxypropyl)-dimethylammonium methylsulphate fatty acid ester having a molar ratio of fatty acid moieties to amine moieties of 1.8 derived from a fatty acid having an average chain length of 18 carbon atoms and an iodine value of about 150. The ester quat active is processed with addition of 10% by weight isopropanol when making this composition, as disclosed in paragraph [0026].

WO 00/06678 discloses incompletely esterified ester quats of branched chain alkanolamines, which are claimed to have low melting points and high hydrolytic stability, and proposes to leave on average one hydroxyl group of the alkanolamine non-esterified. Example 50 discloses a bis-(2-hydroxypropyl)-dimethylammonium methylsulphate fatty acid ester made by quaternising a bis-(2-hydroxypropyl)-methylamine fatty acid ester having a molar ratio of fatty acid moieties to amine moieties of 1.26 derived from a fatty acid having a chain length of 12 to 14 carbon atoms.

DE 36 08 093 A1 discloses concentrated aqueous fabric softener compositions comprising an ester quat with two acyl groups, a fatty acid or an alkali salt thereof in an amount of 1/70 to 1/3 of the amount of the ester quat and a solvent combination of water, glycerol and an additional organic solvent in a total amount of 1/6 to twice the amount of the ester quat. Example 4 discloses a composition containing 45% by weight bis-(2-hydroxypropyl)-dimethylammonium methylsulphate oleic acid diester, 1% by weight tallow fatty acid sodium salt, 11.5% by weight water, 11.5% by weight glycerol, 17.5% by weight 2 propanol, 6% by weight propylene glycol and 3% by weight dipropylene glycol.

The ester quat actives disclosed in DE 24 30 140 C3, EP 1 018 541 A1 and WO 00/06678 have low melting points, but provide insufficient softening performance due to the high degree of unsaturation of the fatty acid moieties or the high content of monoester quat component. On the other hand, similar ester quats derived from bis-(2-hydroxypropyl)-methylamine with a low content of monoester quat, made from fatty acids with a low degree of unsaturation, as the one disclosed in EP 302 567 A2, provide the required softening performance, but show high melting points and melt viscosities and therefore require addition of a solvent for handling and processing.

WO 2011/120822 A1 discloses fabric softener active compositions comprising at least 50% by weight of a bis-(2-hydroxypropyl)-dimethylammonium methylsulphate fatty acid ester having a molar ratio of fatty acid moieties to amine moieties of from 1.5 to 1.99, an average chain length of the fatty acid moieties of from 16 to 18 carbon atoms and an iodine value of the fatty acid moieties, calculated for the free fatty acid, of from 0.5 to 50, and from 0.5 to 5% by weight fatty acid. The fabric softener active compositions may further comprise minor amounts of (2-hydroxypropyl)-(1-methyl-2-hydroxyethyl)-dimethylammonium methylsulphate fatty acid esters, bis-(1-methyl-2-hydroxyethyl)-dimethylammonium methylsulphate fatty acid esters, (2-hydroxypropyl)-(1-methyl-2-hydroxyethyl)-methylamine fatty acid esters and bis-(1-methyl-2-hydroxyethyl)-methylamine fatty acid esters. However, WO 2011/120822 A1 does not disclose any technical effect caused by the presence of these minor components.

It has now been found that fabric softener active compositions based on a bis-(2-hydroxypropyl)-dimethylammonium methylsulphate fatty acid ester, made from fatty acids with a specific chain length and a specific degree of unsaturation and having a particular molar ratio of fatty acid moieties to amine moieties, provide aqueous dispersions with improved storage stability and increased viscosity if they contain a specific amount of the (2-hydroxypropyl)-(1-methyl-2-hydroxyethyl)-dimethylammonium methylsulphate fatty acid ester containing the same fatty acid moiety.

The present invention is therefore directed to a fabric softener active composition, comprising as component A at least 50% by weight of a bis-(2-hydroxypropyl)-dimethylammonium methylsulphate fatty acid ester having a molar ratio of fatty acid moieties to amine moieties of from 1.5 to 1.99, an average chain length of the fatty acid moieties of from 16 to 18 carbon atoms and an iodine value of the fatty acid moieties, calculated for the free fatty acid, of from 0.5 to 50, and as component B a (2-hydroxypropyl)-(1-methyl-2 hydroxyethyl)-dimethylammonium methylsulphate fatty acid ester having the same fatty acid moieties as component A, wherein the molar ratio of component B to component A is from 0.05 to 0.20.

The invention is also directed to a method for making such compositions, comprising the steps of reacting a mixture, containing (2-hydroxypropyl)-(1-methyl-2-hydroxyethyl)-methylamine and bis-(2-hydroxypropyl)-methylamine at a molar ratio of from 0.05 to 0.20, with a fatty acid having an average chain length of from 16 to 18 carbon atoms and an iodine value of from 0.5 to 50 in a molar ratio of fatty acid to amine of from 1.51 to 2.0 with removal of water at a temperature of from 160 to 220° C. until the acid value of the reaction mixture is in the range from 1 to 10 mg KOH/g and further reacting with dimethyl sulphate at a molar ratio of dimethyl sulphate to amine of from 0.90 to 0.97 and preferably from 0.92 to 0.95 until the total amine value of the reaction mixture is in the range from 1 to 8 mg KOH/g.

The fabric softener active composition of the invention comprises as component A at least 50% by weight of a bis-(2-hydroxypropyl)-dimethylammonium methylsulphate fatty acid ester. The use of a methylsulphate salt surprisingly provides both a lower melting point of the composition and a better stability to hydrolysis of an aqueous dispersion of the composition compared to a chloride salt as used in EP 0 293 955 A2 and EP 0 302 567 A2.

Component A is a mixture of at least one diester of formula $(CH_3)_2N^+(CH_2CH(CH_3)OC(=O)R)_2CH_3OSO_3^-$ and at least one monoester of formula $(CH_3)_2N^+(CH_2CH(CH_3)OH)(CH_2CH(CH_3)OC(=O)R)_2CH_3OSO_3^-$, where R is the hydrocarbon group of a fatty acid moiety RCOO. Component A has a molar ratio of fatty acid moieties to amine moieties of from 1.5 to 1.99 and preferably from 1.85 to 1.99. The specified molar ratio is essential for simultaneously achieving high softening performance and low melting point of the composition. A molar ratio in the range from 1.85 to 1.99 provides high softening performance in the absence of anionic surfactants or at low concentrations of such surfactants. Fabric softener active compositions having such a molar ratio are therefore useful for making rinse cycle softeners intended for use in a laundry washing application where the laundry is rinsed several times after the wash before the rinse cycle softener is added. A molar ratio in the range from 1.5 to less than 1.85 provides good softening performance in the presence of anionic surfactants. Fabric softener active compositions having such a molar ratio are therefore useful for making rinse cycle softeners intended for use in a laundry washing application where the rinse cycle softener is added to the rinse immediately following the wash.

The fatty acid moiety of component A is derived from a mixture of fatty acids of formula RCOOH, where R is a hydrocarbon group. The hydrocarbon group may be branched or unbranched and preferably is unbranched.

The fatty acid moiety has an average chain length of from 16 to 18 carbon atoms and an iodine value, calculated for the free fatty acid, of from 0.5 to 50. The average chain length is preferably from 16.5 to 17.8 carbon atoms. Preferably, the fatty acid moiety has an iodine value of from 1.0 to 50, more preferably of from 2 to 50, even more preferably of from 5 to 40 and most preferably of from 15 to 35. The average chain length is calculated on the basis of the weight fraction of individual fatty acids in the mixture of fatty acids. For branched chain fatty acids the chain length refers to the longest consecutive chain of carbon atoms. The iodine value is the amount of iodine in g consumed by the reaction of the double bonds of 100 g of fatty acid, determined by the method of ISO 3961. In order to provide the required average chain length and iodine value, the fatty acid moiety is derived from a mixture of fatty acids comprising both saturated and unsaturated fatty acids. The unsaturated fatty acids are preferably monounsaturated fatty acids. Component A preferably comprises less than 6% by weight of multiply unsaturated fatty acid moieties. Examples of suitable saturated fatty acids are palmitic acid and stearic acid. Examples of suitable monounsaturated fatty acids are oleic acid and elaidic acid. The cis-trans-ratio of double bonds of unsaturated fatty acid moieties is preferably higher than 55:45 and more preferably higher than 65:35. The fraction of multiply unsaturated fatty acid moieties may be reduced by selective touch hydrogenation, which is a hydrogenation that selectively hydrogenates one double bond in a —CH=CH—$CH_2$—CH=CH— substructure but not double bonds of monounsaturated hydrocarbon groups. The specified average chain length and iodine values are essential for simultaneously achieving high softening performance and low melting point of the composition. If the average chain length is less than 16 carbon atoms or the iodine value is higher than 50, the softening performance will be unsatisfactory, whereas the melting point of the composition can get too high if the average chain length is more than 18 carbon atoms.

The fatty acid moiety may be derived from fatty acids of natural or synthetic origin and is preferably derived from fatty acids of natural origin, most preferably from fatty acids of plant origin. The required iodine value can be provided by using a fatty acid mixture of natural origin that already has such an iodine value, for example a tallow fatty acid. Alternatively, the required iodine value can be provided by partial hydrogenation of a fatty acid mixture or a triglyceride mixture having a higher iodine value. In a further and preferred embodiment, the required iodine value is provided by mixing a fatty acid mixture having a higher iodine value with a mixture of saturated fatty acids. The mixture of saturated fatty acids may be obtained either by hydrogenating a fatty acid mixture containing unsaturated fatty acids or from a hydrogenated triglyceride mixture, such as a hydrogenated vegetable oil.

The fabric softener active composition of the invention further comprises as component B a (2-hydroxypropyl)-(1-methyl-2-hydroxyethyl)-dimethylammonium methylsulphate fatty acid ester having the same fatty acid moieties as component A.

Component B is preferably a mixture of at least one diester of formula $(C_3)_2N^+(CH_2CH(CH_3)OC(=O)R)(CH(CH_3)CH_2OC(=O)R)CH_3OSO_3^-$, at least one monoester of formula $(C_3)_2N^+(CH_2CH(CH_3)OH)(CH(CH_3)CH_2OC$ (=O)R)$CH_3OSO_3$- and at least one monoester of formula $(C_3)_2N^+(CH_2CH(CH_3)OC(=O)R)(CH(CH_3)CH_2OH)$ $CH_3OSO_3$-, where R is the hydrocarbon group of the same fatty acid moiety RCOO as in component A.

The fabric softener active composition of the invention preferably comprises components A and B in a combined amount of from 85 to 99% by weight.

The fabric softener active composition of the present invention may further comprise a fatty acid in addition to components A and B. The composition preferably comprises from 0.5 to 5% and more preferably from 2 to 5% by weight fatty acid. The fatty acid may be present as free fatty acid or in the form of a salt of the fatty acid with non-quaternised bis-(2-hydroxypropyl)-methylamine esters. The fabric softener active composition preferably comprises a fatty acid mixture, which is preferably of natural origin and most preferably of plant origin. Most preferably, the fatty acid moieties of component A are derived from the same fatty acid mixture as present in the composition in an amount of from 0.5 to 5% by weight. The presence of additional fatty acid provides a low melting point of the composition without compromising storage stability in aqueous dispersion. By adjusting the amount of fatty acid within the claimed range, compositions of the present invention can be made which have low melt viscosities without using any solvent or diluent. Such compositions enable the manufacture of aqueous rinse cycle softener dispersions containing no solvent or a minimum amount of solvent.

The fabric softener active composition of the present invention preferably comprises less than 2% by weight and more preferably less than 0.5% by weight of water. Compositions having such low water content show improved storage stability in the molten state and therefore can be stored and delivered as liquids without compromising product quality. Compositions comprising more water show a much higher melt viscosity and are therefore difficult to process into an aqueous dispersion.

The fabric softener active composition of the present invention preferably comprises less than 10% by weight and more preferably less than 1% by weight of solvents having a flash point of less than 20° C.

In one embodiment of the invention, the fabric softener active composition of the present invention comprises up to 9.9% by weight and preferably up to 5% by weight of at least one solvent selected from glycerol, ethylene glycol, propylene glycol, dipropylene glycol and C1-C4 alkyl monoethers of ethylene glycol, propylene glycol and dipropylene glycol. Examples of suitable glycol C1-C4 alkyl monoethers are 2-methoxyethanol, 2-ethoxyethanol, 2-butoxyethanol, 1-methoxy-2-propanol, dipropylene glycol monomethyl ether and dipropylene glycol monobutyl ether. The compositions according to this embodiment have the advantages of low melt viscosity and a close to Newtonian melt rheology, i.e. the viscosity shows little change with shear strength.

In another embodiment, the fabric softener active composition of the present invention comprises from 2 to 8% by weight of a fatty acid triglyceride having an average chain length of the fatty acid moieties of from 10 to 14 carbon atoms and an iodine value, calculated for the free fatty acid, of from 0 to 15. Compositions according to this embodiment also have the advantages of low melt viscosity and a close to Newtonian melt rheology, i.e. the viscosity shows little change with shear strength.

In a preferred alternative embodiment, the amount of solvents present in the fabric softener active composition is less than 5% by weight and more preferably less than 1% by weight. The compositions according to this embodiment can be further processed in a molten state to provide aqueous solvent free dispersions.

In addition to components A and B and optionally a solvent, the fabric softener active composition of the present invention may preferably further comprise from 1.5 to 10% by weight of a bis-(2-hydroxypropyl)-methylamine fatty acid ester containing the same fatty acid moieties as component A. The bis-(2-hydroxypropyl)-methylamine fatty acid ester is preferably a mixture of at least one diester of formula $(CH_3)N(CH_2CH(CH_3)OC(=O)R)_2$ and at least one monoester of formula $(CH_3)N(CH_2CH(CH_3)OH)(CH_2CH(CH_3)OC(=O)R)$. A part of the bis-(2-hydroxypropyl)-methylamine fatty acid ester can be present in the form of a salt if the fabric softener active composition additionally comprises fatty acid. Such salts are of structure $HN^+(CH_3)(CH_2CH(CH_3)OC(=O)R)_2$ $RCOO^-$ or $HN^+(CH_3)(CH_2CH(CH_3)OH)(CH_2CH(CH_3)OC(=O)R)$ $RCOO^-$. The presence of the bis-(2-hydroxypropyl)-methylamine fatty acid ester in the specified amount further lowers the melting point of the composition, without compromising softening performance and storage stability in aqueous dispersion. In this embodiment, the composition may further contain a (2-hydroxypropyl)-(1-methyl-2-hydroxyethyl)-methylamine fatty acid ester, which is preferably a mixture of at least one diester of formula $(CH_3)N(CH_2CH(CH_3)OC(=O)R)(CH(CH_3)CH_2OC(=O)R)$, at least one monoester of formula $(CH_3)N(CH_2CH(CH_3)OH)(CH(CH_3)CH_2OC(=O)R)$ and at least one monoester of formula $(CH_3)N(CH_2CH(CH_3)OC(=O)R)(CH(CH_3)CH_2OH)$.

The fabric softener active composition of the present invention may also further comprise minor amounts of bis-(1-methyl-2-hydroxyethyl)-dimethylammonium methylsulphate fatty acid esters and bis-(1-methyl-2-hydroxyethyl)-methylamine fatty acid esters.

The fabric softener active composition of the present invention is useful for supplying a fabric softener active from a manufacturer of quaternary ammonium salts to a consumer products manufacturer and for further processing to consumer products, such as rinse cycle fabric softener or fabric softening drier sheets. The fabric softener active composition is stable and safe during transport, storage and further processing, and compositions with low water content are particularly stable with regard to hydrolysis of the ester. The high concentration of fabric softener active in the composition saves on transport costs. The fabric softener active composition can be processed to a rinse cycle fabric softener by dispersing the molten fabric softener active composition in hot water or a hot aqueous solution and subsequent cooling, adding further components, such as for example electrolyte, dye, perfume, thickener or antifoam, before or after dispersing the fabric softener active composition. The fabric softener active composition can be processed to a dryer sheet by adding further components, such as for example perfume, to the molten fabric softener active composition, impregnating a sheet material with the resulting mixture, cooling and cutting the impregnated sheet material to the desired size.

The fabric softener active composition of the present invention can be prepared by reacting an amine mixture, containing (2-hydroxypropyl)-(1-methyl-2-hydroxyethyl)-methylamine and bis-(2-hydroxypropyl)-methylamine at a molar ratio of from 0.05 to 0.20, with a fatty acid having an average chain length of from 16 to 18 carbon atoms and an iodine value of from 0.5 to 50 in a molar ratio of fatty acid to amine of from 1.51 to 2.0 and quaternizing the resulting product with dimethyl sulphate. Amine mixtures containing (2-hydroxypropyl)-(1-methyl-2-hydroxyethyl)-methylamine and bis-(2-hydroxypropyl)-methylamine at a suitable molar ratio can be prepared by reacting methylamine with propylene oxide at appropriate reaction conditions and are commercially available from BASF and from Lanxess.

Preferably, the fabric softener active composition of the present invention is prepared by the method of the invention, comprising the steps of reacting a mixture, containing (2-hydroxypropyl)-(1-methyl-2-hydroxyethyl)-methylamine and bis-(2-hydroxypropyl)-methylamine at a molar ratio of from 0.05 to 0.20, with a fatty acid having an average chain length of from 16 to 18 carbon atoms and an iodine value of from 0.5 to 50 in a molar ratio of fatty acid to amine of from 1.51 to 2.0 with removal of water at a temperature of from 160 to 220° C. until the acid value of the reaction mixture is in the range from 1 to 10 mg KOH/g and further reacting with dimethyl sulphate at a molar ratio of dimethyl sulphate to amine of from 0.90 to 0.97 and preferably from 0.92 to 0.95 until the total amine value of the reaction mixture is in the range from 1 to 8 mg KOH/g.

In the first step of the method of the invention, the mixture of amines is reacted with the fatty acid in a molar ratio of fatty acid to amine of from 1.51 to 2.0, preferably from 1.86 to 2.0, with removal of water. The reaction carried out at a temperature of from 160 to 220° C. Water is preferably removed by distillation from the reaction mixture. During the course of the reaction, the pressure is preferably reduced from ambient pressure to a pressure in the range from 100 to 5 mbar to enhance the removal of water. The first step may be carried out in the presence of an acidic catalyst, which is preferably used in an amount of from 0.05 to 0.2% by weight. Suitable acidic catalysts are methanesulfonic acid, p-toluenesulfonic acid and hypophosphorous acid. The reaction is carried out until the acid value of the reaction mixture is in the range from 1 to 10 mg KOH/g. The acid value is determined by titration with a standardised alkaline solution according to ISO 660 and is calculated as mg KOH per g sample. The reaction can then be stopped by cooling to a temperature below 80° C. in order to avoid further reaction of the fatty acid and maintain unreacted fatty acid in the final product.

In the second step of the method of the invention, the reaction mixture obtained in the first step is reacted with dimethyl sulphate at a molar ratio of dimethyl sulphate to amine of from 0.90 to 0.97 and preferably from 0.92 to 0.95. The reaction is preferably carried out at a temperature of from 60 to 100° C. The reaction is carried out until the total amine value of the reaction mixture is in the range from 1 to 8 mg KOH/g. The total amine value is determined by non-aqueous titration with perchloric acid according to method Tf2a-64 of the American Oil Chemists Society and is calculated as mg KOH per g sample.

The method of the invention has the advantage of providing a fabric softener active composition according to the invention containing components A and B and free fatty acid without requiring any step in addition to the steps of esterification and quaternization.

The invention is illustrated by the following examples, which are however not intended to limit the scope of the invention in any way.

EXAMPLES

Example 1

1372 g (4.98 mol) of a partially hydrogenated vegetable fatty acid having an iodine value of 19.5 and an average chain length of the fatty acid moieties of 17.3 was placed with 0.2% by weight of 50% by weight hypophosphorous acid in an electrically heated reactor equipped with a thermometer, a mechanical stirrer and a rectifying column. 380 g (2.58 mol) of an amine mixture, containing 93% by weight bis-(2-hydroxypropyl)-methylamine and 7% by weight (2-hydroxypropyl)-(1-methyl-2 hydroxyethyl)-methylamine, was added with stirring. The resulting mixture was heated with stirring to 190° C. and was kept at this temperature for 4 h at ambient pressure, distilling off water through the rectifying column. The pressure was then reduced to 10 mbar and the mixture was further stirred at 190° C., water being removed with a vacuum pump until an acid value of the reaction mixture of 6.7 mg KOH/g was reached. The resulting mixture was then cooled to 70° C., 299.7 g (2.37 mol) of dimethyl sulphate was added and the resulting mixture was stirred for 2 h at 70 to 90° C.

The resulting fabric softener active composition was a viscous liquid at 90° C., having a total amine value of 4.8 mg KOH/g. HPLC analysis (Waters Spherisorb® SCX column, methanol eluent with a formic acid triethylamine buffer, RI detection) showed the bis-(2-hydroxypropyl)-dimethylammonium methylsulphate fatty acid ester to be composed of 8.2% monoester and 91.8% diester (rel. area percentages). $^{13}C$ NMR spectra of the composition showed bis-(2-hydroxypropyl)-dimethylammonium methylsulphate fatty acid monoester, bis-(2-hydroxypropyl)-dimethylammonium methylsulphate fatty acid diester and (2-hydroxypropyl)-(1-methyl-2 hydroxyethyl)-dimethylammonium methylsulphate fatty acid diester in molar ratios of 0.14:0.75:0.11.

Example 2 (Comparative Example)

237 g (2.34 mol) triethylamine were added to a solution of 176.6 g (1.2 mol) bis-(2-hydroxypropyl)-methylamine in 2500 g dichloromethane. 690 g (2.34 mol) of fatty acid chloride, prepared from the fatty acid used in example 1, were added drop wise with stirring and cooling to keep the temperature in a range of 40 to 45° C. The mixture was stirred for a further 12 h at this temperature, cooled to ambient temperature and 4000 g dichloromethane were added. The resulting solution was washed several times with saturated aqueous NaCl solution, aqueous $Ca(OH)_2$ solution and 50% by weight aqueous $K_2CO_3$ solution and dried with $Na_2SO_4$. Dichloromethane was distilled off to provide 628 g of an esteramine mixture having an acid value of 2.3 mg KOH/g.

108.5 g (0.86 mol) of dimethyl sulphate were added to the esteramine mixture at 65 to 90° C. and the resulting mixture was for 2 h at this temperature.

The resulting fabric softener active composition was a viscous liquid at 90° C., having a total amine value of 5.5 mg KOH/g. HPLC analysis showed the bis-(2-hydroxypropyl)-dimethylammonium methylsulphate fatty acid ester to be comprised of 6.2% monoester and 93.8% diester (rel. area percentages). $^{13}C$ NMR spectra of the composition showed bis-(2-hydroxypropyl)-dimethylammonium methylsulphate fatty acid monoester and bis-(2-hydroxypropyl)-dimethylammonium methylsulphate fatty acid diester in molar ratios of 0.084:0.916, but no (2-hydroxypropyl)-(1-methyl-2-hydroxyethyl)-dimethylammonium methylsulphate fatty acid ester.

Example 3 (Comparative Example)

Example 2 was repeated using a mixture of 95.5% by weight bis-(2-hydroxypropyl)-methylamine and 4.5% by weight (2-hydroxypropyl)-(1-methyl-2-hydroxyethyl)-methylamine instead of pure bis-(2-hydroxypropyl)-methylamine. 641 g of an esteramine mixture having an acid value of 2.6 mg KOH/g were obtained and reacted with 107.1 g (0.85 mol) of dimethyl sulphate as in example 2.

The resulting fabric softener active composition was a viscous liquid at 90° C., having a total amine value of 5.9 mg KOH. $^{13}C$ NMR spectra of the composition showed bis-(2-hydroxypropyl)-dimethylammonium methylsulfate fatty acid monoester, bis-(2-hydroxypropyl)-dimethylammonium methylsulfate fatty acid diester and (2-hydroxypropyl)-(1-methyl-2-hydroxyethyl)-dimethylammonium methylsulfate fatty acid diester in molar ratios of 0.10:0.86:0.04.

Example 4

A rinse cycle fabric softener containing 7.7% by weight fabric softener active composition of example 1, 0.044% by weight formic acid, 0.01% by weight HCl, 0.02% by weight $CaCl_2$, 0.007% by weight hydroxyethylidene-1,1-diphosphonic acid monosodium salt (NaHEDP), 0.1% by weight polydimethylsiloxane Dow Corning® MP-10 antifoam emulsion, 2.4% by weight perfume, less than 0.1% by weight dye and the remainder water was prepared as follows.

The fabric softener active composition, preheated to 85° C., was added with stirring with a Rushton turbine to a mixture of water, formic acid, HCl, $CaCl_2$ and NaHEDP kept at 63-64° C. The resulting dispersion was cooled to room temperature and the further components were added with stirring with a high shear mixer at 8000 $min^{-1}$ for 15 s.

The resulting rinse cycle fabric softener had a viscosity of 742 mPa*s determined after 24 h with a Brookfield® DV-E viscosimeter at 20° C. and a rotation speed of 60 $min^{-1}$.

Example 5 (Comparative Example)

Example 4 was repeated using the fabric softener active composition of example 2.

The resulting rinse cycle fabric softener had a viscosity of 49 mPa*s.

Example 6 (Comparative Example)

Example 4 was repeated using the fabric softener active composition of example 3.

The resulting rinse cycle fabric softener had a viscosity of 281 mPa*s.

Example 7

Example 4 was repeated using 5.2% by weight fabric softener active composition of example 1, 0.045% by weight formic acid, 0.01% by weight HCl, 0.02% by weight $CaCl_2$, 0.007% by weight hydroxyethylidene-1,1-diphosphonic acid monosodium salt (NaHEDP), 0.1% by weight polydimethylsiloxane Dow Corning® MP-10 antifoam emulsion, 2.2% by weight perfume, 0.03% by weight cationic acrylic polymer thickener Rheovis® CDE supplied by BASF, less than 0.1% by weight dye and the remainder water.

The resulting rinse cycle fabric softener had a viscosity of 44 mPa*s. No phase separation was observed after storage for 3 weeks at 20° C.

Example 8 (Comparative Example)

Example 7 was repeated using the fabric softener active composition of example 2.

The resulting rinse cycle fabric softener had a viscosity of 13 mPa*s. Phase separation occurred during storage for 3 weeks at 20° C.

Example 9 (Comparative Example)

Example 7 was repeated using the fabric softener active composition of example 3. The resulting rinse cycle fabric softener had a viscosity of 29 mPa*s. No phase separation was observed after storage for 3 weeks at 20° C.

Examples 3 to 9 demonstrate that a rinse cycle fabric softener made from the fabric softener active composition of the present invention has higher viscosity and better storage stability compared with a rinse cycle fabric softener made from a fabric softener active composition containing only component A and no component B or containing components A and B with a molar ratio of component B to component A of less than 0.05.

The invention claimed is:

1. A fabric softener active composition, comprising:

a) as component A, at least 50% by weight of a bis-(2-hydroxypropyl)-dimethylammonium methylsulphate fatty acid ester having a molar ratio of fatty acid moieties to amine moieties of from 1.5 to 1.99, an average chain length of the fatty acid moieties of from 16 to 18 carbon atoms and an iodine value of the fatty acid moieties, calculated for the free fatty acid, of from 0.5 to 50; and b) as component B, a (2-hydroxypropyl)-(1-methyl-2-hydroxyethyl)-dimethylammonium methylsulphate fatty acid ester having the same fatty acid moieties as component A;

wherein the molar ratio of component B to component A is from 0.05 to 0.20.

2. The fabric softener active composition of claim 1, wherein the molar ratio of fatty acid moieties to amine moieties is from 1.85 to 1.99.

3. The fabric softener active composition of claim 1, wherein the iodine value of the fatty acid moieties, calculated for the free fatty acid, is from 5 to 40.

4. The fabric softener active composition of claim 1, wherein the iodine value of the fatty acid moieties, calculated for the free fatty acid, is from 15 to 35.

5. The fabric softener active composition of claim 1, wherein the combined amount of components A and B is from 85 to 99% by weight.

6. The fabric softener active composition of claim 5, wherein the cis-trans-ratio of double bonds of unsaturated fatty acid moieties of component A is higher than 55:45.

7. The fabric softener active composition of claim 6, comprising less than 2% by weight of water.

8. The fabric softener active composition of claim 7, further comprising from 2 to 8% by weight of a fatty acid triglyceride having an average chain length of the fatty acid moieties of from 10 to 14 carbon atoms and an iodine value, calculated for the free fatty acid, of from 0 to 15.

9. The fabric softener active composition of claim 1, wherein component A comprises less than 6% by weight of multiply unsaturated fatty acid moieties.

10. The fabric softener active composition of claim 1, wherein the cis-trans-ratio of double bonds of unsaturated fatty acid moieties of component A is higher than 55:45.

11. The fabric softener active composition of claim 1, comprising less than 2% by weight of water.

12. The fabric softener active composition of claim 1, comprising less than 0.5% by weight of water.

13. The fabric softener active composition of claim 1, comprising less than 10% by weight of solvents having a flash point of less than 20° C.

14. The fabric softener active composition of claim 1, comprising less than 1% by weight of solvents having a flash point of less than 20° C.

15. The fabric softener active composition of claim 1, further comprising up to 9.9% by weight of at least one solvent selected from glycerol, ethylene glycol, propylene glycol, dipropylene glycol and C1-C4 alkyl monoethers of ethylene glycol, propylene glycol and dipropylene glycol.

16. The fabric softener active composition of claim 1, further comprising from 2 to 8% by weight of a fatty acid triglyceride having an average chain length of the fatty acid moieties of from 10 to 14 carbon atoms and an iodine value, calculated for the free fatty acid, of from 0 to 15.

17. The fabric softener active composition of claim 1, further comprising from 1.5 to 10% by weight of a bis-(2-hydroxypropyl)-methylamine fatty acid ester containing the same fatty acid moieties as component A.

18. A method for making the fabric softening composition of claim 1, comprising the steps:

a) reacting a mixture, containing (2-hydroxypropyl)-(1-methyl-2-hydroxyethyl)-methylamine and bis-(2-hydroxypropyl)-methylamine at a molar ratio of from 0.05 to 0.20, with a fatty acid having an average chain length of from 16 to 18 carbon atoms and an iodine value of from 0.5 to 50, in a molar ratio of fatty acid to amine of from 1.51 to 2.0, with removal of water at a temperature of from 160 to 220° C. until the acid value of the reaction mixture is in the range from 1 to 10 mg KOH/g; and b) reacting the product of step a) with dimethyl sulphate at a molar ratio of dimethyl sulphate to amine of from 0.90 to 0.97 until the total amine value of the reaction mixture is in the range from 1 to 8 mg KOH/g.

19. The method of claim 18, wherein, in step b), said the molar ratio of dimethyl sulphate to amine is from of from 0.92 to 0.95.

20. The method of claim 18, wherein the molar ratio of fatty acid to amine is from 1.86 to 2.0.

* * * * *